US007361035B1

(12) United States Patent
Lai

(10) Patent No.: US 7,361,035 B1
(45) Date of Patent: Apr. 22, 2008

(54) CARD CONNECTOR CAPABLE OF PREVENTING ELECTRONIC CARD FROM ACCIDENTAL DISENGAGEMENT THEREFROM

(75) Inventor: Yaw-Huey Lai, Taipei County (TW)

(73) Assignee: Tai-Sol Electronics Co., Ltd., Taipei (TW)

( * ) Notice: Subject to any disclaimer, the term of this patent is extended or adjusted under 35 U.S.C. 154(b) by 0 days.

(21) Appl. No.: 11/637,770

(22) Filed: Dec. 13, 2006

(30) Foreign Application Priority Data

Sep. 29, 2006 (TW) ..... 95217474 U

(51) Int. Cl.
*H01R 13/62* (2006.01)

(52) U.S. Cl. ..... 439/155; 439/159

(58) Field of Classification Search ..... 439/159, 439/155

See application file for complete search history.

(56) References Cited

U.S. PATENT DOCUMENTS 6,685,490 B1 * 2/2004 Xue et al. ..... 439/159
6,764,327 B2 * 7/2004 Yu ..... 439/188
6,929,491 B1 * 8/2005 Chi-Te ..... 439/159
6,951,471 B1 * 10/2005 Chen ..... 439/159
7,033,190 B1 * 4/2006 Chen ..... 439/159
7,104,820 B1 * 9/2006 Lu et al. ..... 439/159
2005/0272290 A1 * 12/2005 Yoneyama et al. ..... 439/159
2005/0272291 A1 * 12/2005 Chang ..... 439/159
2006/0089032 A1 * 4/2006 Chen ..... 439/159
2006/0089033 A1 * 4/2006 Chen ..... 439/159

* cited by examiner

*Primary Examiner*—Tulsidas C. Patel
*Assistant Examiner*—Vladimir Imas
(74) *Attorney, Agent, or Firm*—Bacon & Thomas, PLLC

(57) ABSTRACT

A card connector capable of preventing a card from accidental disengagement therefrom includes a housing having a base plate, a stationary terminal area located at a first side of the base plate, and a slide channel located the base plate; a slide member slidably mounted in the slide channel; and an anti-run member having a main body, a fastening piece mounted on the slide member, and a buckle portion having an extension piece. A convexity is formed on the second side of the base plate and located close to the stationary terminal area. An opening is formed on the base plate and located in front of the convexity. In light of this, the convexity blocks the movement of the buckle portion toward the second side, thus securely locking the buckle portion in the concavity of the card and effectively preventing the card from backing and disengagement from the card connector.

11 Claims, 10 Drawing Sheets

CARD CONNECTOR CAPABLE OF PREVENTING ELECTRONIC CARD FROM ACCIDENTAL DISENGAGEMENT THEREFROM

BACKGROUND OF THE INVENTION

1. Field of the Invention

The present invention relates generally to electronic card connectors, and more particularly, to a card connector capable of preventing a card from accidental disengagement therefrom.

2. Description of the Related Art

A conventional card connector, as shown in FIG. 16, includes a slide member 4' and an anti-run buckle 5' fixed to the slide member 4' and having a buckle portion 56'. While a card 7' is inserted into the card connector, the card 7' pushes the slide member 4' to move backward and the buckle portion 56' is correspondingly buckled into a concavity 72' located at a side of the card 7'. When the card connector is violently shocked or wobbled, the buckle portion 56' of the anti-run buckle 5' likely disengages from the concavity 72' of the card 7' to further disengage the card 7' from the card connector.

SUMMARY OF THE INVENTION

The primary objective of the present invention is to provide a card connector which can effectively prevent a card from accidental disengagement therefrom.

The foregoing objective of the present invention is attained by the card connector composed of a housing, a slide member, and an anti-run member. The housing includes a base plate, a stationary terminal area located at a first side of the base plate for mounting conductive terminals, and a slide channel located on the base plate. The slide member is slidably mounted in the slide channel for forward and backward slidable movement. The anti-run member includes a main body, a fastening piece bending and extending from a rear end of the main body, and a buckle portion bending and extending toward the first side from a front end of the main body and having an extension piece. The fastening piece is fixed onto the slide member. A convexity is formed at the second side of the base plate and located close to the stationary terminal area. An opening is formed in front of the convexity. In light of this, the convexity blocks the movement of the buckle portion toward the second side, thus securely locking the buckle portion in the concavity of the card and effectively preventing the card from backing and disengagement from the card connector.

DETAILED DESCRIPTION OF PREFERRED EMBODIMENTS

Figure 1:
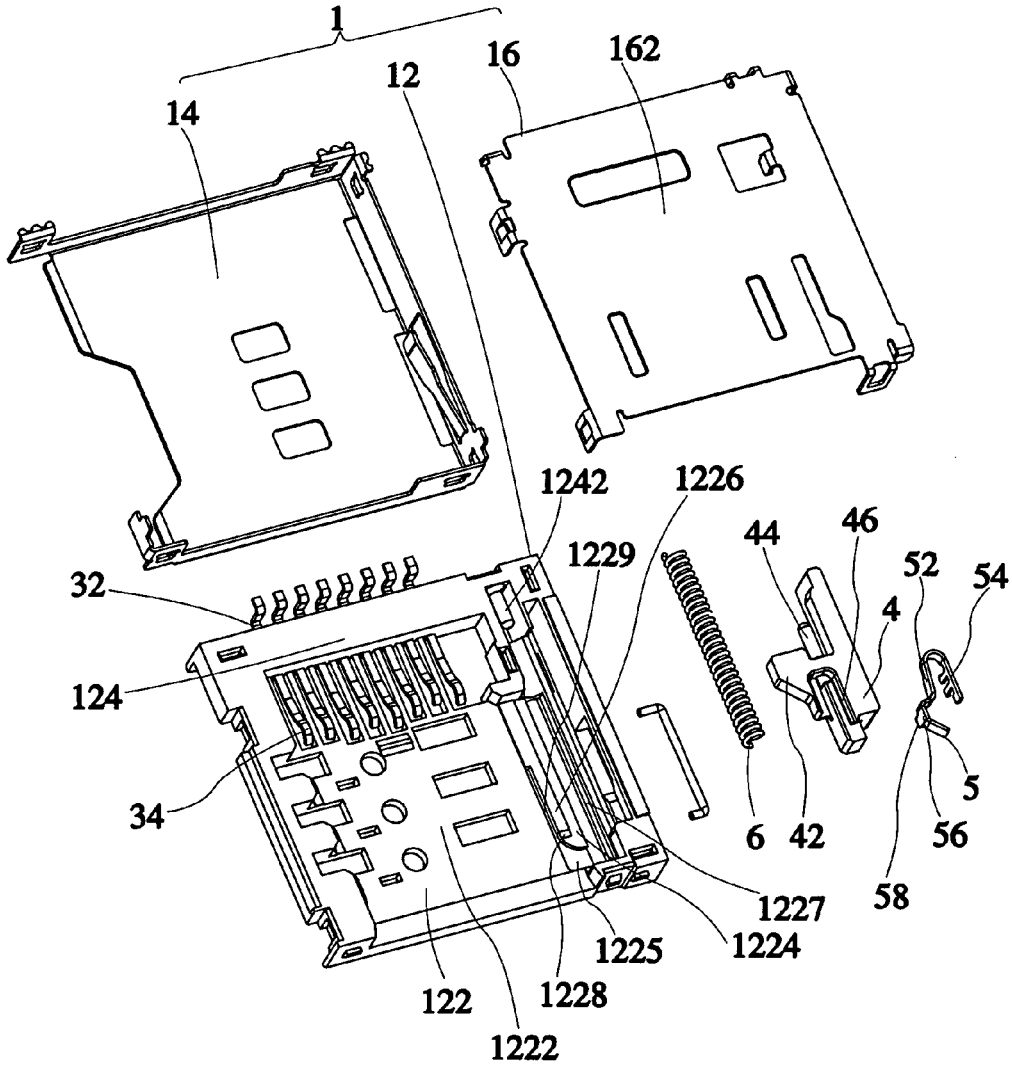
FIG. 1 is an exploded view of a first preferred embodiment of the present invention.
Figure 2:
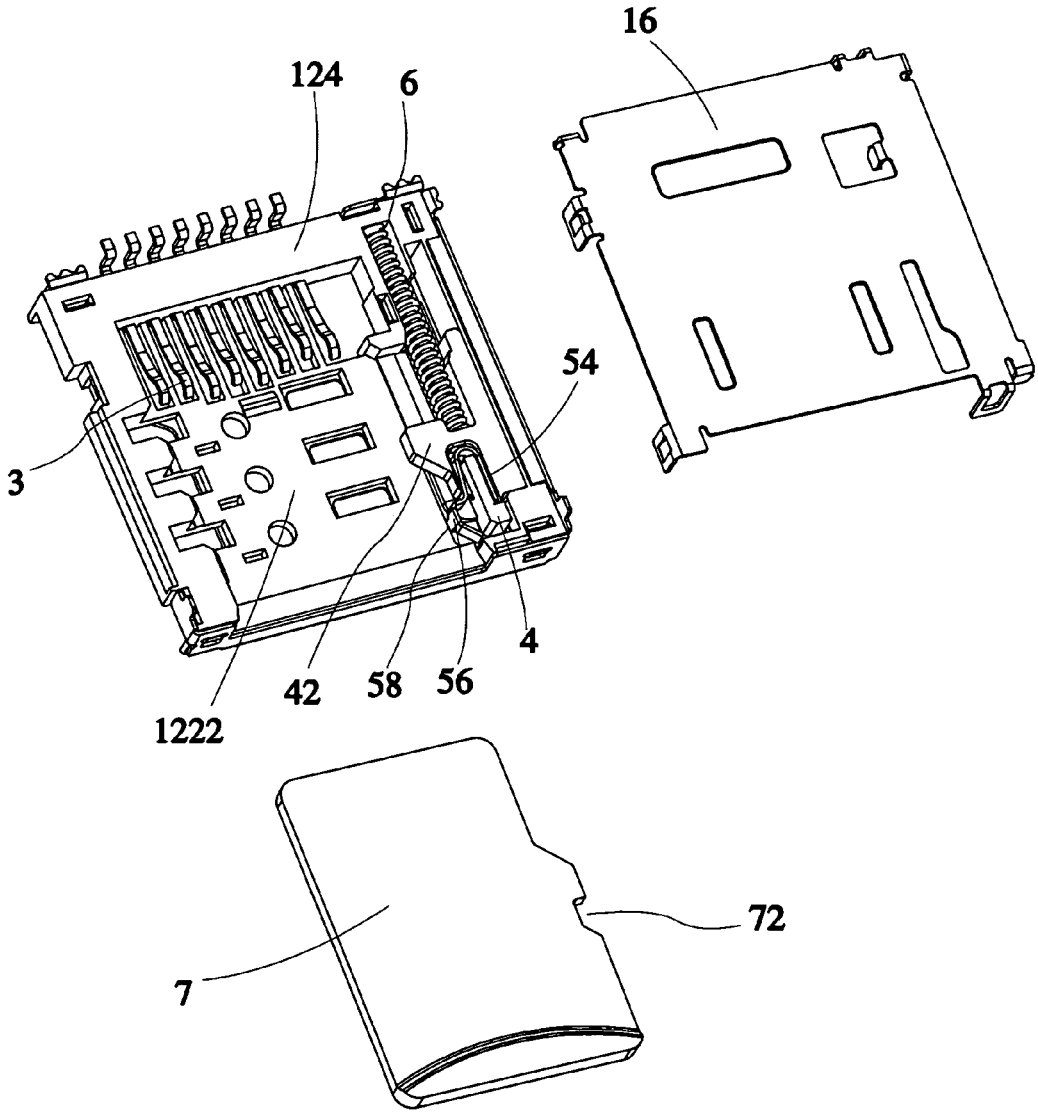
FIG. 2 is a perspective view of the first preferred embodiment of the present invention, illustrating an electronic card and the card connector which top cover is removed therefrom and located beside it.
Figure 3:
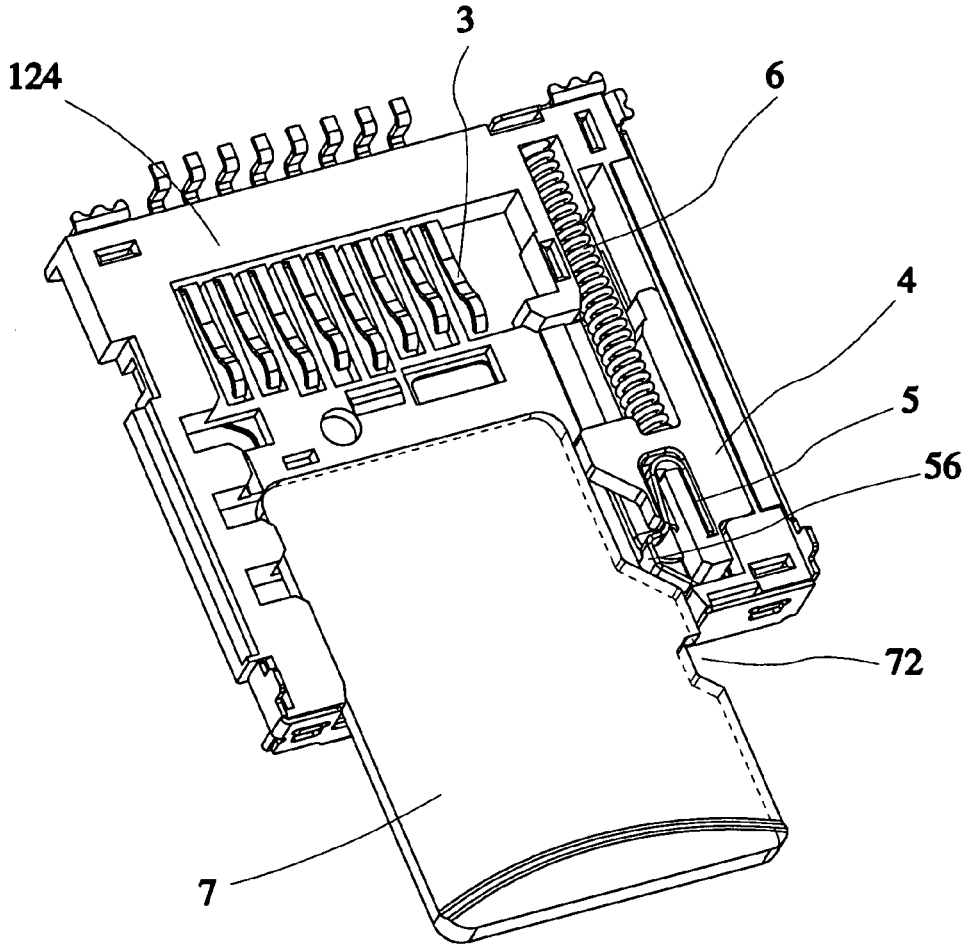
FIG. 3 is a perspective view of the first preferred embodiment of the present invention which top cover is removed therefrom, illustrating the card is initially inserted therein.
Figure 6:
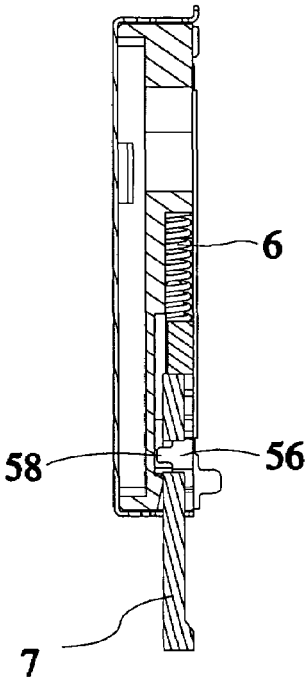
FIG. 6 is a cross-sectional view taken along a line 6-6 indicated in FIG. 4.
Figure 4:
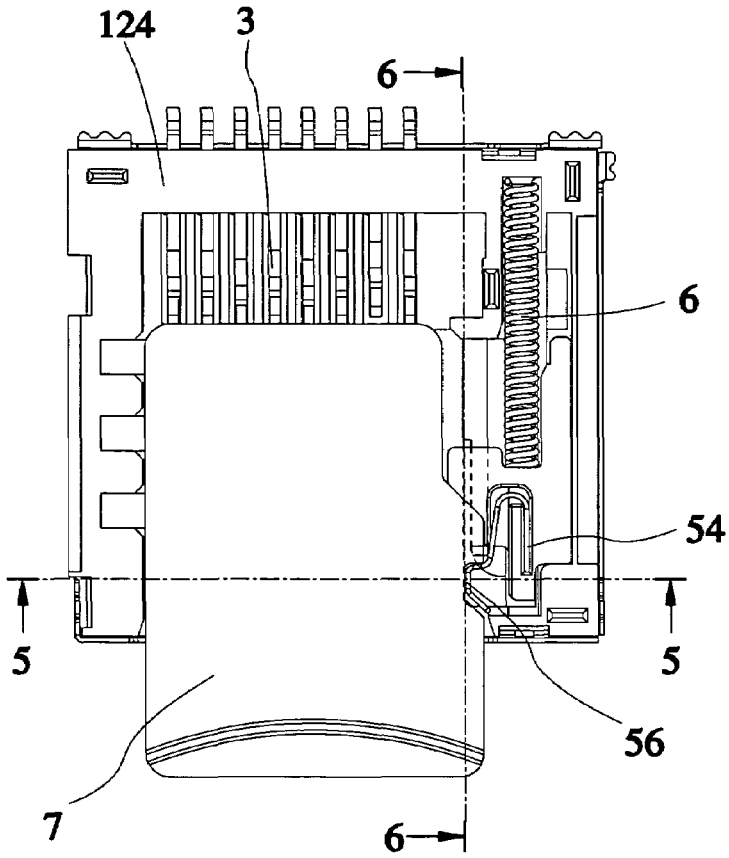
FIG. 4 is a top view of the first preferred embodiment of the present invention which top cover is removed therefrom, illustrating the card is partly inserted therein.
Figure 5:
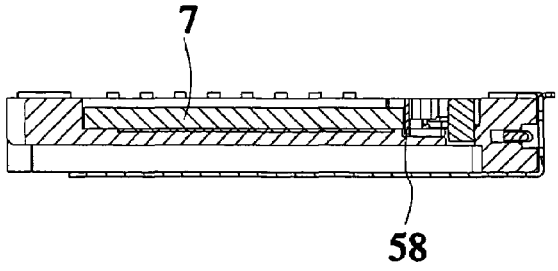
FIG. 5 is a cross-sectional view taken along a line 5-5 indicated in FIG. 4.
Figure 9:
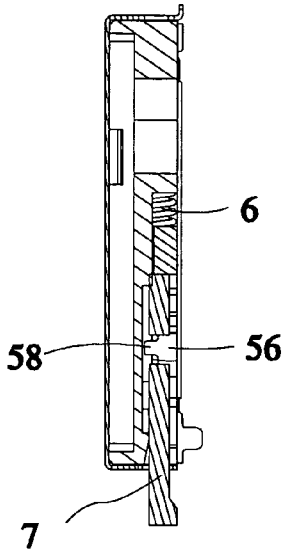
FIG. 9 is a cross-sectional view taken from a line 9-9 indicated in FIG. 7.
Figure 7:
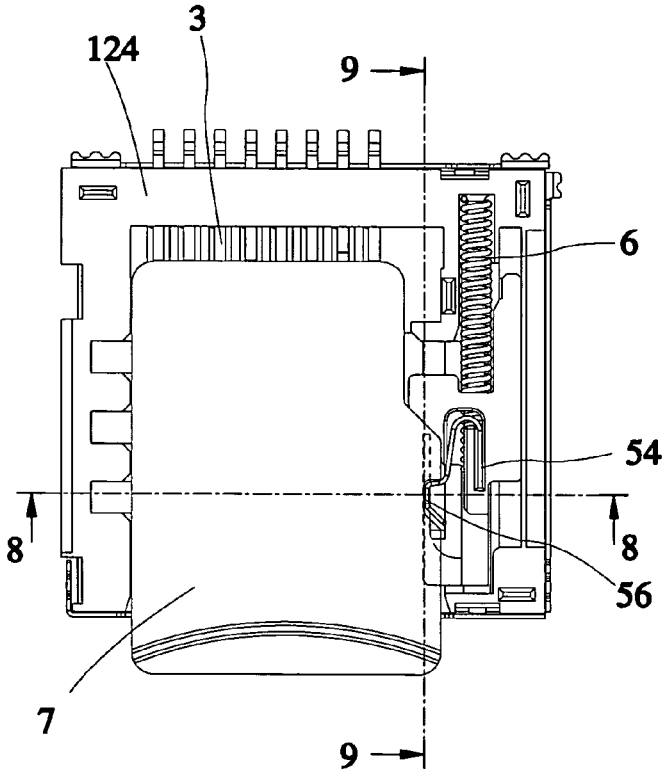
FIG. 7 is a top view of the first preferred embodiment of the present invention which top cover is removed therefrom, illustrating the card is mostly inserted therein.
Figure 8:
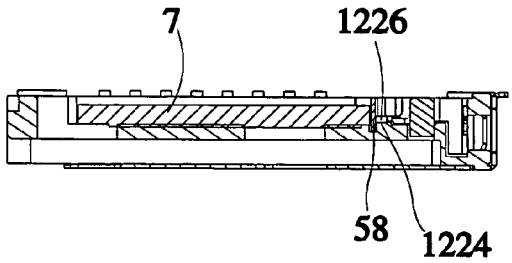
FIG. 8 is a cross-sectional view taken from a line 8-8 indicated in FIG. 7.
Figure 10:
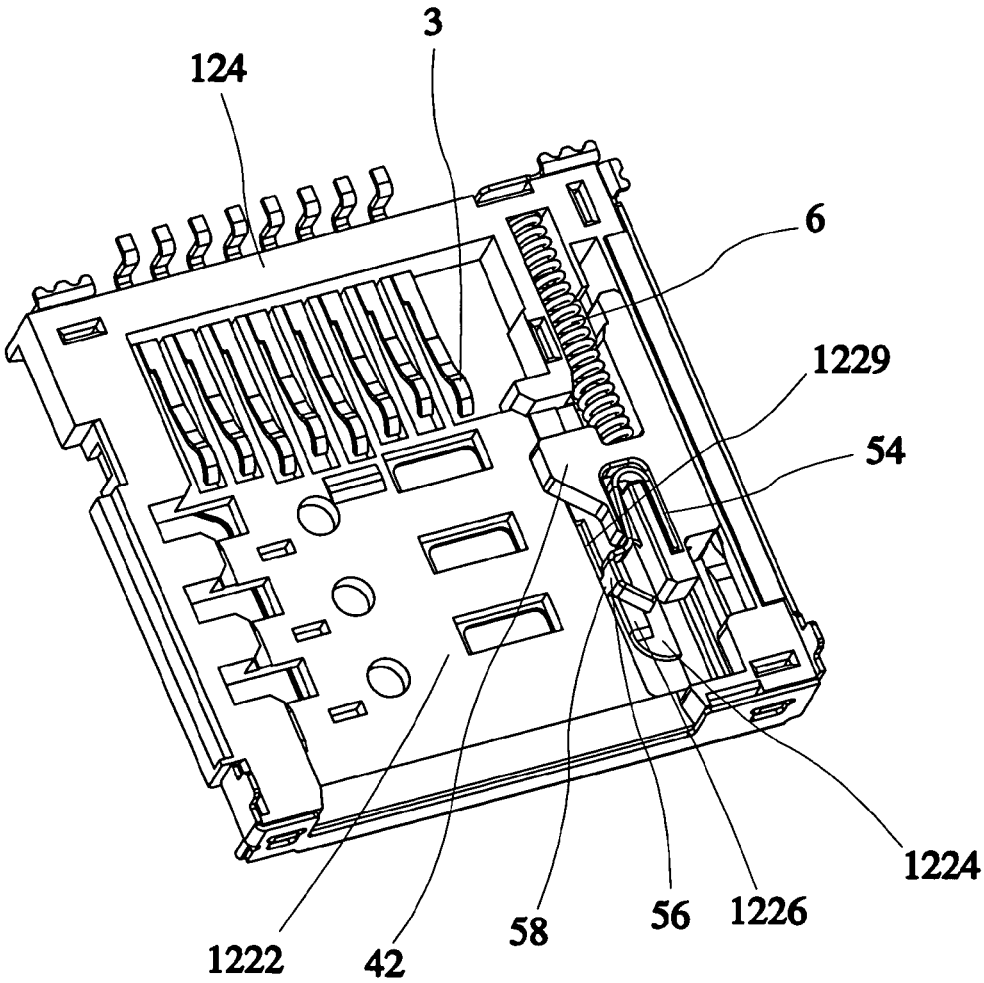
FIG. 10 is a perspective view of the first preferred embodiment of the present invention which top cover is removed therefrom, illustrating where the slide member is located while the card is mostly inserted.

Referring to FIGS. 1-10, a card connector capable of preventing an electronic card from accidental disengagement therefrom, constructed according to a first preferred embodiment of the present invention, is composed of a housing 1, a group of conductive terminals 3, a slide member 4, an anti-run member 5, and a spring 6.

The housing 1 includes a base 12, a bottom cover 14, and a top cover 16.

The base 12 includes a base plate 122, a rear plate 124. The base plate 122 has a stationary terminal area 1222 formed at a first side thereof for mounting the conductive terminals, a lower convexity 1224 formed at a second side thereof and located close to the stationary terminal area 1222, an opening 1225 formed in front of the lower convexity 1224, an upper convexity 1226 formed on the lower convexity 1224 and located close to the stationary terminal area 1222 and extending longitudinally, and an inclined guide portion 1228 formed at a front end of the upper convexity 1226. A groove 1229 is formed among the lower convexity 1224, the upper convexity 1226, and the stationary terminal area 1222. A slide channel 1227 is formed at a second side of the lower convexity 1224. A first projecting bar 1242 is formed on the rear plate 124, corresponding to the slide channel 1227. The bottom cover 14 is buckled to a bottom side of the base 12. The top cover 16 is buckled to a top side of the base 12, including a top cover 162.

The conductive terminals 3 each include a root portion 32 and a contact portion 34. Each of the root portions 32 is inserted in the rear plate 124. Each of the contact portions 34 is mounted to the stationary terminal area 1222.

The slide member 4 is slidably mounted to the slide channel 1227 for longitudinally slidable movement. The slide member 4 includes a triangular stopping portion 42 extending toward a first side thereof from a top end thereof, a second projecting bar 44 formed at a rear end thereof and corresponding to the first projecting bar 1242 of the rear plate 124, and an n-shaped fastening slot 46 formed on the slide member 4.

The anti-run member 5 includes a main body 52, a fastening piece 54 bending toward a first side thereof from and extending forward from a rear end of the main body 52, an arched buckle portion 56 bending and extending toward the first side thereof toward the first side thereof from a front end of the main body 52, and an extension piece 58 extending vertically downward from the buckle portion 56. The fastening piece 54 is mounted to the fastening slot 46.

The spring 6 includes two ends inserted onto the first projecting bar 1242 of the rear plate 124 and onto the second projecting bar 44 of the slide member 4 respectively.

When the card connector of the present invention is being assembled, first mount the fastening piece 54 of the anti-run member 5 to the fastening slot 46 of the slide member 4, and then mount the slide member 4 to a front end of the slide channel 1227, enabling the buckle portion 56 and the extension piece 58 to be located at the opening 1225 and the extension piece 58 to be aligned with the groove 1229; mount the spring 6 to between the rear plate 124 and the slide member 4 and between the bottom cover 14 and the top cover 16.

While an electronic card 7 having a concavity 72 formed at one side thereof is inserted into the card connector, the card 7 squeezes and moves the buckle portion 56 of the anti-run member 5 toward a second side until the buckle portion 56 is buckled into the concavity 72 of the card 7. In the meantime, the card 7 pushes the slide member 4 to move toward the rear plate 124 and the anti-run member 5 is moved toward the rear plate 124; the extension piece 58 is moved backward along the groove 1229; the main body 52 is moved along the guide portion 1228 to climb the upper convexity 1226; the extension piece 58 is located in the groove 1229, having one side blocked by the stationary terminal area 1222 and the opposite side thereof blocked by the lower and upper convexities 1224 and 1226. When the card connector is violently shocked and wobbled, the extension piece 58 is blocked by the upper convexity 1226, the buckle portion 56 fails to disengage from the concavity 72 of the card 7. Thus, the buckle portion 56 is still securely buckled into the concavity 72 to effectively prevent the card 7 from backing and disengagement from the card connector.

In the present invention, the base 12 includes the upper convexity 1226 and the buckle portion 56 includes the extension piece 58. When the card 7 pushes the slide member 4 to move backward, the extension piece 58 is moved along the first side of the upper convexity 1226; because the upper convexity 1226 blocks the movement the extension piece 58 toward the second side, the card 7 is securely locked in the concavity 72 of the card 7, thus effectively preventing the card 7 from backing and disengagement.

It is to be noted that the above-mentioned first and second sides are the left and right sides in this embodiment. The first side can alternatively be the right side and the second side can alternatively be the left side, which are the equivalent interchange of the present invention and fall in the scope of the appended claim.

Figure 11:
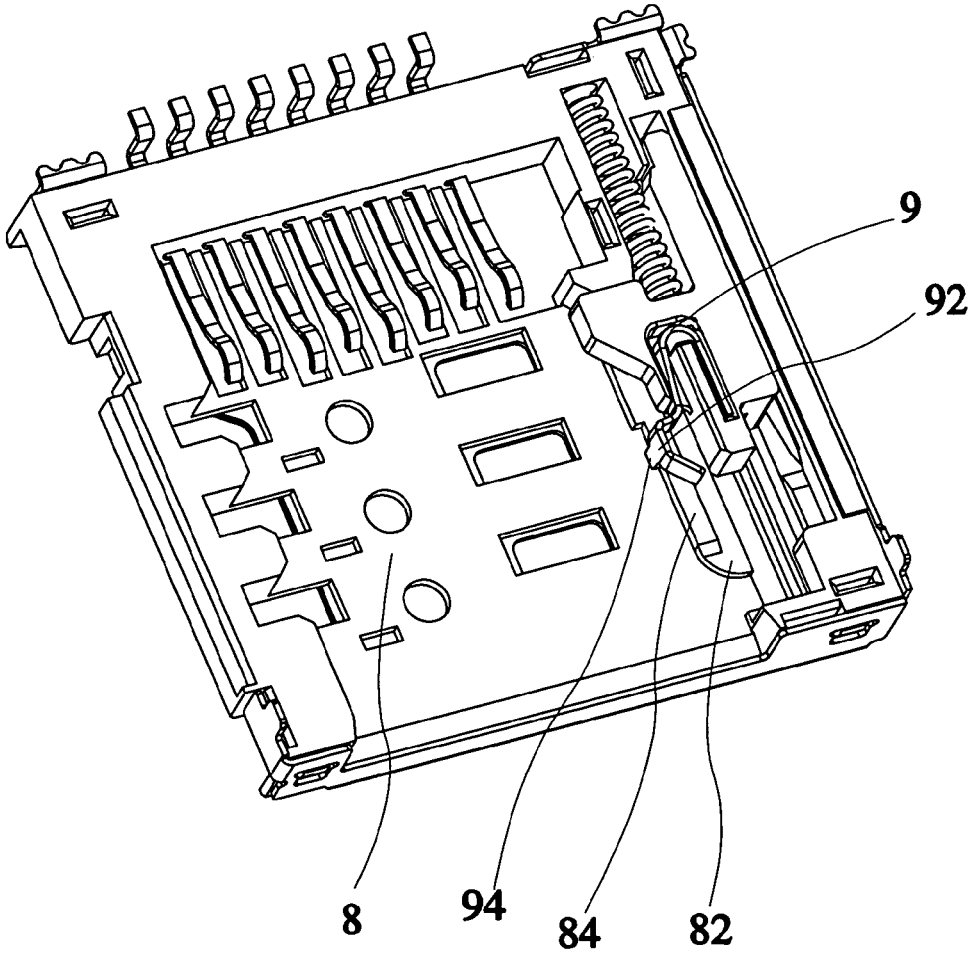
FIG. 11 is a perspective view of a second preferred embodiment of the present invention which top cover is removed therefrom, illustrating the card is fully inserted therein.
Figure 12:
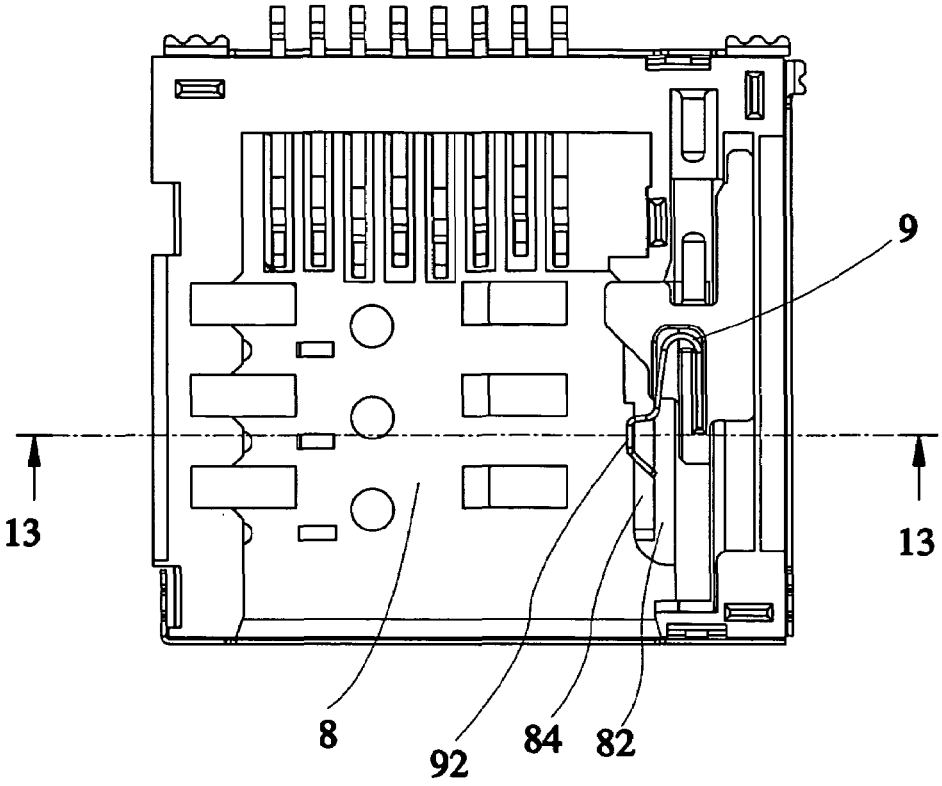
FIG. 12 is a cross-sectional view taken from a line 12-12 indicated in FIG. 11.
Figure 13:
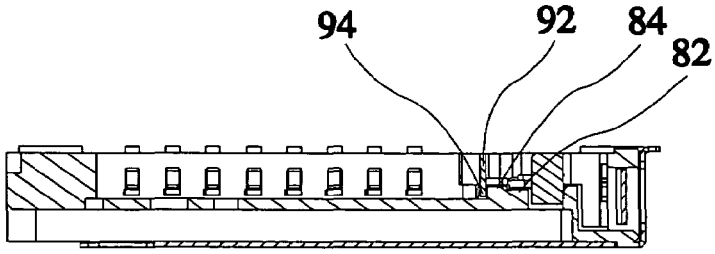
FIG. 13 is a cross-sectional view taken from a line 13-13 indicated in FIG. 11.
Figure 14:
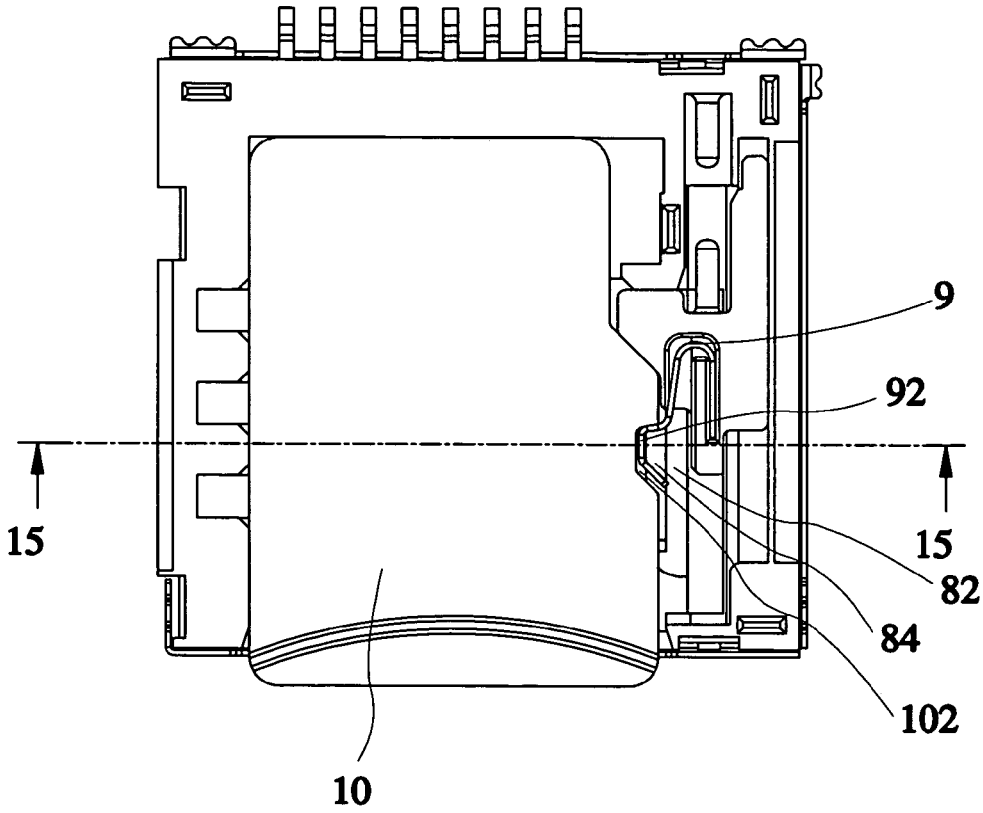
FIG. 14 is a top view of the second preferred embodiment of the present invention which top cover is removed therefrom, illustrating the card is fully inserted therein.
Figure 15:
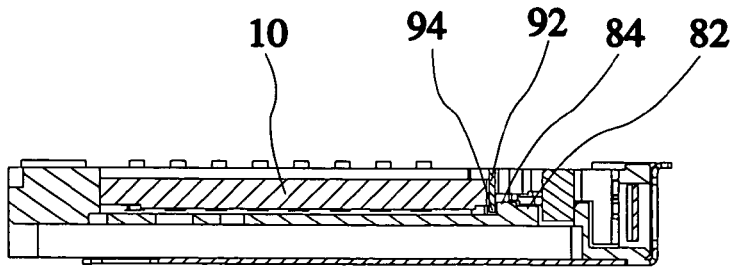
FIG. 15 is a cross-sectional view taken from a line 15-15 indicated in FIG. 14.
Figure 16:
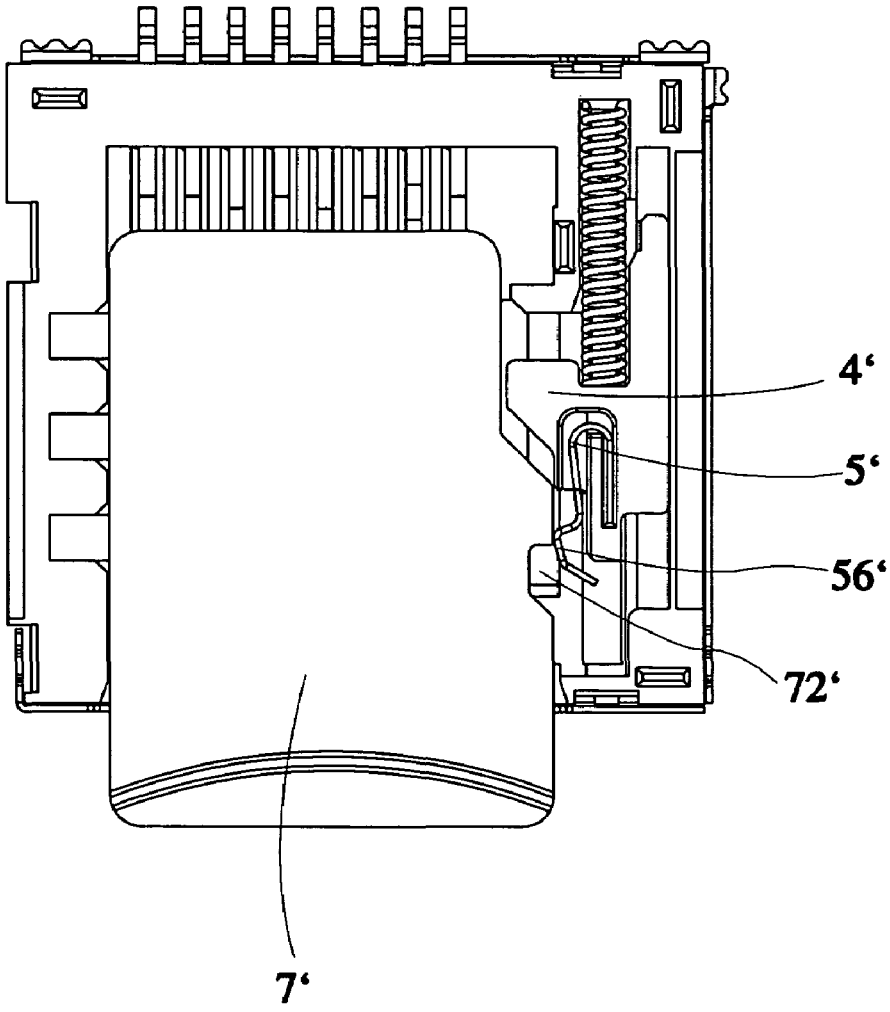
FIG.16 PRIOR ART
FIG. 16 is a top view of the conventional card connector.

Referring to FIGS. 11-15, a card connector capable of preventing an electronic card from accidental disengagement therefrom, constructed according to a second preferred embodiment of the present invention, is similar to the first embodiment. The base 8 includes a lower convexity 82 and an upper convexity 84. The anti-run member 9 includes a buckle portion 92 and an extension piece 94 extending downward from the buckle portion 92. However, no groove 1229 of the first embodiment is provided at the first side of the lower and upper convexities 92 and 94. Because the extension piece 94 is blocked at the first side of the upper convexity 84, the buckle portion 92 fails to disengage from the concavity 102 of the card 10, thus effectively preventing the card 10 from backing and disengagement from the card connector.

Although the present invention has been described with respect to a specific preferred embodiment thereof, it is no way limited to the details of the illustrated structures but changes and modifications may be made within the scope of the appended claims.

What is claimed is:

1. A card connector capable of preventing a card from disengagement therefrom, comprising:

a housing having a base plate, a stationary terminal area formed at a first side of said base plate for mounting conductive terminals, a slide channel formed on said base plate, an upper convexity formed at the second side of said base plate and located close to said stationary terminal area, and an opening formed in front of said upper convexity;

a slide member slidably mounted in said slide channel for forward and backward slidable movement; and an anti-run member having a main body, a fastening piece bending and extending from a rear end of said main body, and a buckle portion bending and extending from a front end of said main body and having an extension piece, said fastening piece being mounted onto said slide member such that said buckle portion buckles is buckled into a concavity on the card to prevent the card from disengaging from the card connector, wherein said extension piece extends from said buckle portion to engage said base plate and hold said buckle portion in said concavity when said card and slide member are slid forwardly into said card connector.

2. The card connector as defined in claim 1, wherein the first side is the left side and the second side is the right side.

3. The card connector as defined in claim 1, wherein the first side is the right side and the second side is the left side.

4. The card connector as defined in claim 1, wherein said upper convexity comprises an inclined guide portion formed at a front end thereof.

5. The card connector as defined in claim 1 or 2 or 3 or 4, wherein said base plate comprises a lower convexity formed at the second side of said base and located close to said stationary terminal area; said upper convexity is located on said lower convexity and close to said stationary terminal area; said opening is located in front of said lower convexity.

6. The card connector as defined in claim 5, wherein said upper convexity extends upward longitudinally.

7. The card connector as defined in claim 5, wherein said housing further comprises a groove formed among said lower convexity, said upper convexity, and said stationary terminal area.

8. The card connector as defined in claim 5, wherein said buckle portion is arched.

9. The card connector as defined in claim 1 or 2 or 3 or 4, wherein said extension piece extends vertically downward from said buckle portion.

10. The card connector as defined in claim 1, wherein when said slide member is pushed forwardly into said card connector, said upper convexity engages said extension piece to prevent movement of said buckle portion and thereby hold said buckle portion in said concavity of said card.

11. The card connector as defined in claim 1, wherein when said slide member is pushed forwardly into said card connector, said extension piece engages a groove in said base plate to prevent movement of said buckle portion and thereby hold said buckle portion in said concavity of said card.

* * * * *